United States Patent [19]

Zeblisky

[11] 4,049,258

[45] Sept. 20, 1977

[54] METHOD OF AND APPARATUS FOR FEEDING SHEETS

[75] Inventor: Joseph A. Zeblisky, Jersey City, N.J.

[73] Assignee: General Corrugated Machinery Co., Inc., Palisades Park, N.J.

[21] Appl. No.: 711,617

[22] Filed: Aug. 4, 1976

[51] Int. Cl.[2] ..... B65H 1/30

[52] U.S. Cl. ..... 271/151; 271/3.1; 214/6 C; 214/6 D; 214/8.5 A

[58] Field of Search ..... 271/3.1, 149–151; 198/443; 214/1 Q, 1 QA, 6 C, 6 D, 7, 8.5 A

[56] References Cited

U.S. PATENT DOCUMENTS

| | | | |
|---|---|---|---|
| 3,201,114 | 8/1965 | Swartz et al. | 271/150 X |
| 3,422,969 | 1/1969 | Miller et al. | 271/3.1 UX |
| 3,459,420 | 8/1969 | Huntwork | 271/150 |
| 3,881,718 | 5/1975 | Fernandez-Rana et al. | 271/150 X |

*Primary Examiner*—Robert W. Saifer
*Attorney, Agent, or Firm*—Samuelson & Jacob

[57] ABSTRACT

Method and apparatus wherein flat corrugated paperboard sheets in stacks are rearranged into a horizontally shingled array of the desired faced orientation and fed toward an exit in the apparatus, each stack being fed onto a conveyor, then tilted to a first posture wherein the sheets are not yet in the horizontally shingled array, but are supported with their edges resting on the conveyor and with their faces making an acute angle facing the exit, the sheets then being moved toward the exit while supported on their edges in the first posture, and then being dropped from the first posture into a second posture, wherein the sheets are in the shingled array, and into juxtaposition with shingled sheets of a previous stack on the conveyor for establishing a flow of continuously shingled sheets toward the exit.

4 Claims, 9 Drawing Figures

METHOD OF AND APPARATUS FOR FEEDING SHEETS

Figure 1:
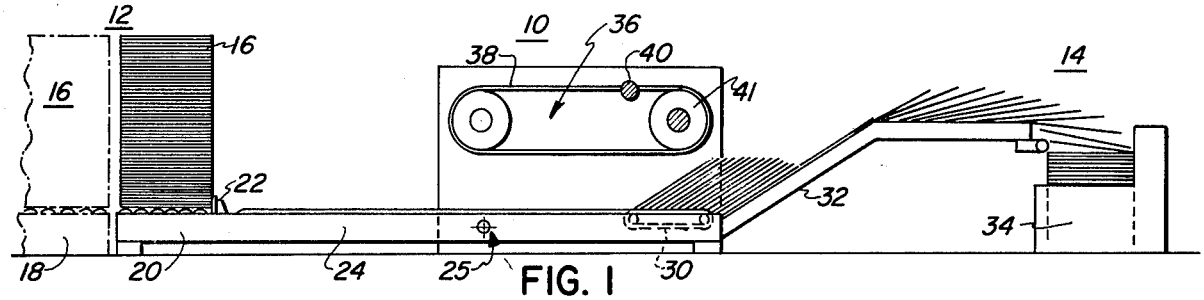

The invention relates to a method of and apparatus for feeding sheets such as corrugated paperboard case blanks. More particularly, the invention is directed toward accepting a stack of horizontal sheets and delivering them as a flow of shingled horizontal sheets in a desired faced orientation to a hopper, other receptacle or the input of a further machine. This invention is an alternative to that of the copending application of George A. Ventz, Ser. No. 711,479 filed Aug. 4, 1976 which is owned by the assignee hereof.

Various constructions have been disclosed in the prior art for operating upon a stack of horizontal sheets to accomplish the purpose of the method and apparatus described herein. One of the earliest of such disclosures is contained in U.S. Pat. No. 3,422,969, issued Jan. 21, 1969, which is owned by the assignee hereof. Since that patent issued and other work in the field was done by the assignee hereof and others, it became evident that certain additional improvements were needed in order to obtain the high performance necessary for economical commercial operation on a production line.

For example, it has been found that one obtains clumps of sheets which do not feed evenly if the leading sheets from a subsequent stack do not properly contact the trailing sheets from the previous stack. As a consequence, manual control of the feed must be exercised from the time a stack of horizontal sheets enters the apparatus until the sheets are delivered at the exit.

Another difficulty with the prior art apparatus arises when the sheets are deposited on the conveyor so that they do not shingle properly and become misaligned in the transverse dimension of the machine. In either of the above described cases, it is necessary for the machine operator to straighten the sheets out by hand. While this may appear an appropriate technique for solving the problems, it is uneconomical, time consuming and perhaps inviting of accidents. Too often, operating personnel become impatient and, as a consequence, take some careless action because of their frustration with the less than perfect operation of the machine.

The method of and the apparatus for feeding sheets of the instant invention are directed toward overcoming the inherent difficulties of the prior art methods and devices. In particular, the invention is directed toward obtaining a smoothly operating efficient result with a minimum of manual operation.

Broadly, the invention provides for receiving a stack of horizontal sheets and holding the stack at the entrance until the conveyor is ready to receive it. When a first predetermined condition is met, the stack is fed onto the conveyor and is placed so that the individual sheets rest on their edges and will be in the desired faced orientation at the exit. The faces of the edge resting sheets form an acute angle with the conveyor which angle faces the exit. The sheets are held in this position until a second predetermined condition is reached. At that time, the sheets are pushed forward so that the leading sheet contacts the trailing sheet of the previous stack of sheets. The sheets now drop onto the conveyor to deliver them in shingled fashion to the exit. Frequently, the sheets are collected in a magazine or hopper but they may be delivered to any other device such as the input of a printer-slotter or other machine.

It is an important object of the invention to provide a method of and apparatus for delivering a flow of sheets at the exit in a desired faced orientation.

It is a further object of the invention to provide a method of and means for delivering a stack of horizontal sheets to the entrance at a first predetermined condition.

It is another object of the invention to provide a method of and means for supporting the sheets on their edges with the acute angle facing the exit until a second predetermined condition is reached.

It is a still further object to move the edge resting sheets so that its leading sheet is in contact with the trailing sheet of the previous stack when the second predetermined condition is reached.

Figure 5:
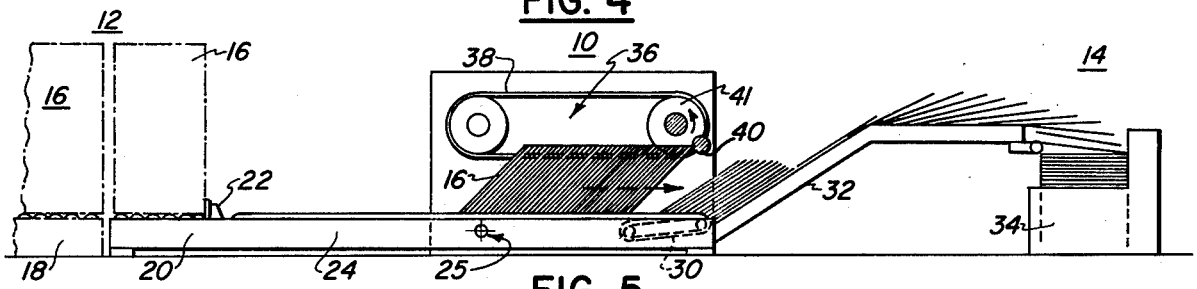
Figure 6:
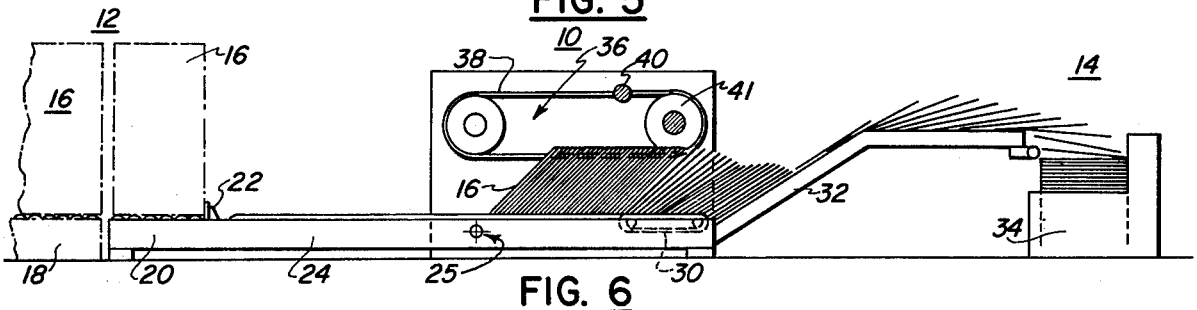
Figures 7, 7A:
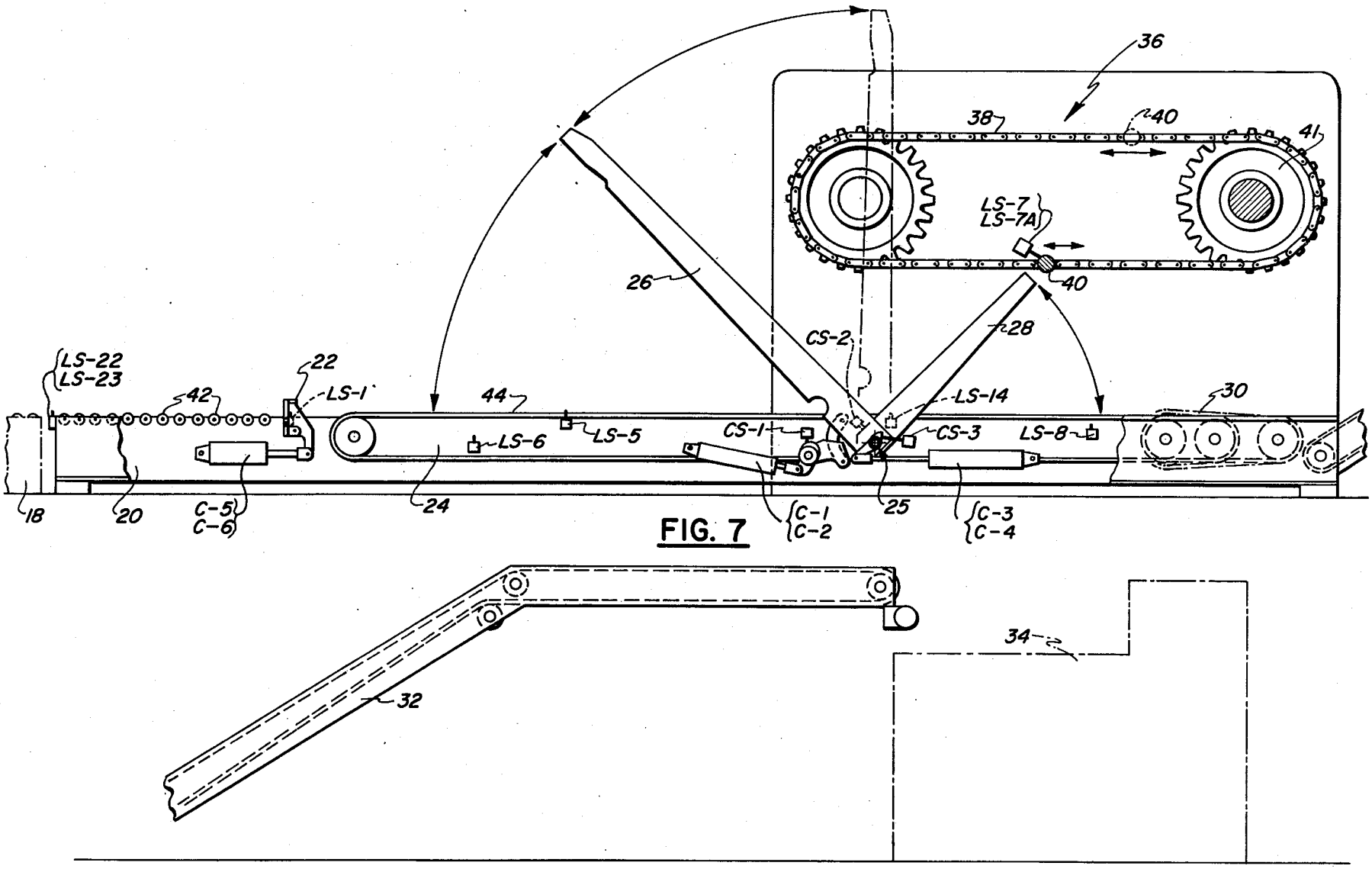
Figure 8:
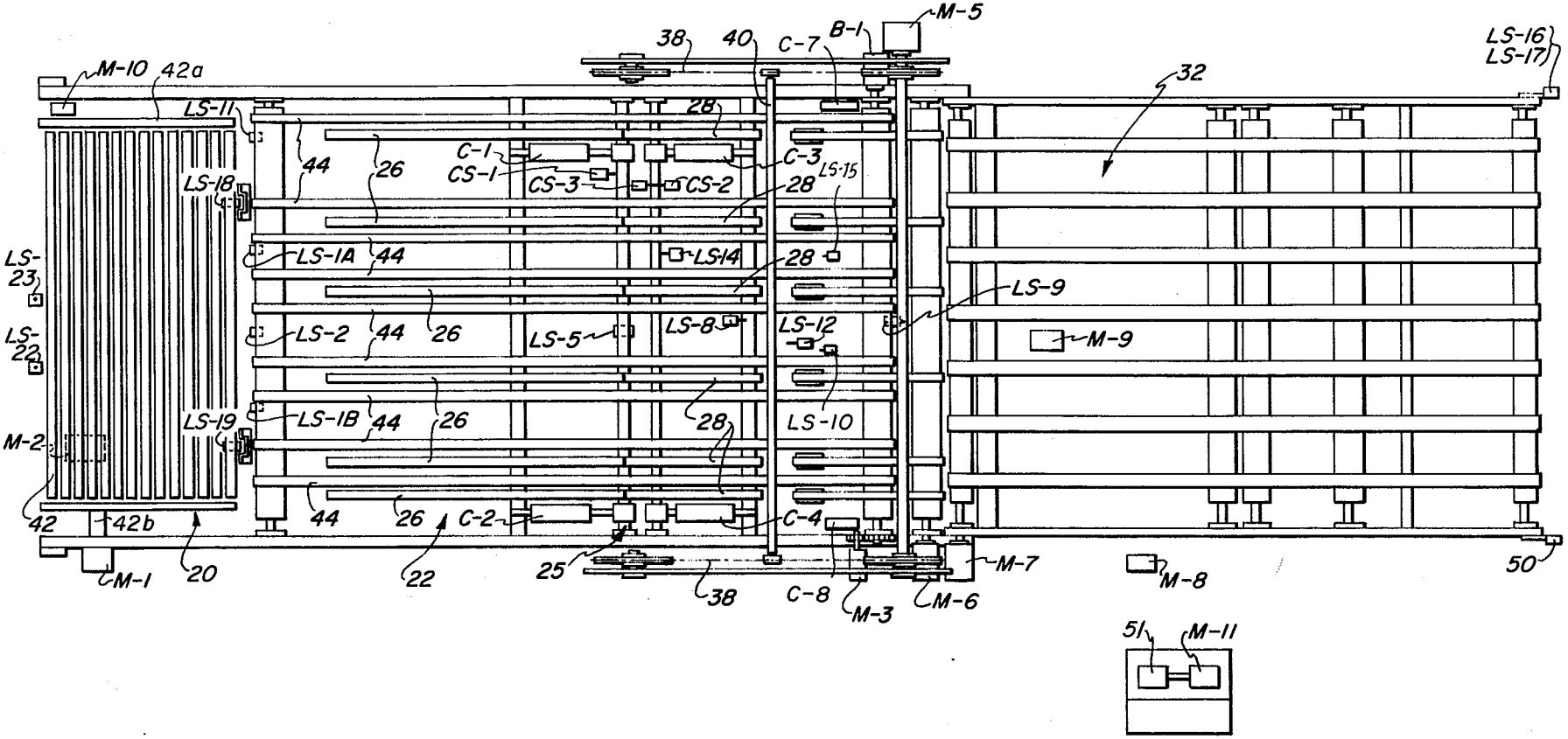

These and other objects, advantages, features and uses will be apparent during the course of the following description when taken together with the accompanying drawing wherein:

FIGS. 1–6 are diagrammatic side elevational views of various steps in the operation of a preferred embodiment of the invention;

FIGS. 7 and 7A, joined on the lines A—A, together depict a side elevational view of the embodiment of FIGS. 1–6 on a larger scale; and FIG. 8 is a horizontal plan view of the embodiment of FIGS. 1–7A on a somewhat smaller scale than that of FIGS. 7 and 7A.

In the drawing, wherein, for the purpose of illustration, there is shown a preferred embodiment of the invention and wherein, like numerals designate like parts throughout the same, the numeral 10 designates an apparatus or machine of the invention, generally. Machine 10 is provided with an entrance or entrance end 12 and an exit or exit end 14.

A customer's conveyor 18 is adjacent the entrance end 12 which is provided with an infeed conveyor 20. The infeed conveyor 20 utilizes at least one stop or gate 22 to preclude movement of a stack 16 of horizontal sheets beyond the infeed conveyor 20 until the machine 10 is ready for it.

Two sets of orienting slats or forks 26 and 28 are associated with main conveyor 24 and are pivoted at the area 25 which is designated the upsetting position. In the embodiment illustrated, the longer (or inner) forks 26 contact the edges of the sheets and the shorter (or outer) forks 28 contact the face of the bottom sheet. In some machines, in which very large sheets are processed, outer forks 28 may be equal in length or longer than inner forks 26. Moreover, while the particular embodiment of the invention described and shown herein is used to deliver the sheets at the exit 14 in the same faced orientation in which they enter the machine, the invention is equally useful on machines in which the faced orientation of the sheets is reversed in the apparatus.

Interleaved with main conveyor 24, there is a short intermediate conveyor section 30 which is movable among three positions. The details of the operation of this conveyor section 30 is described in the aforesaid application of George A. Ventz. Since the section 30 does not form a part of this invention, its construction details are not described herein.

Figure 2:
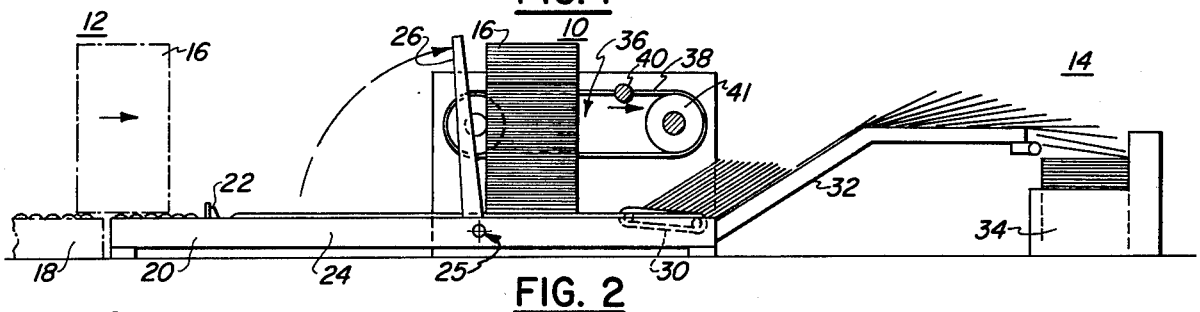
Figure 3:
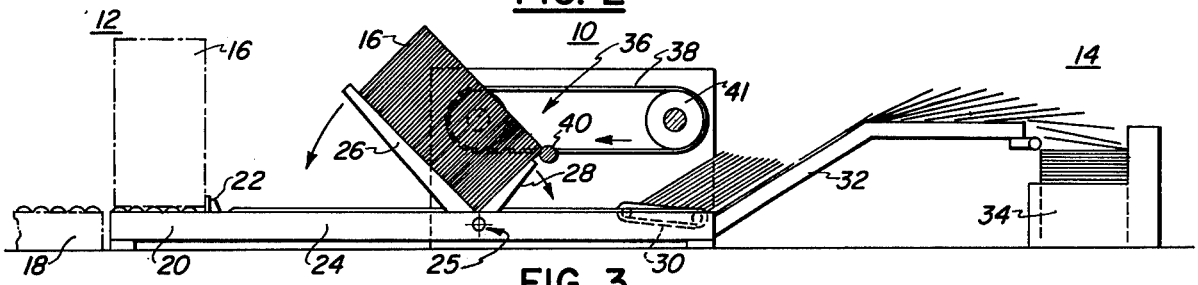
Figure 4:
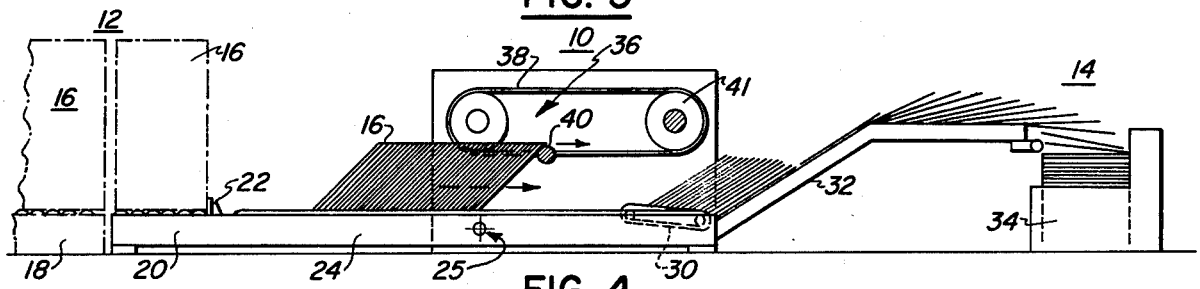

In FIGS. 1 and 6, the conveyor section 30 is on the same level as conveyor 24 and the conveyor 24 and the conveyor section 30 run at the same speed. In FIGS. 2, 3 and 4, the entrance end of conveyor section 30 is above the level of conveyor 24 so the sheets are precluded from entering upon conveyor section 30. In FIG. 5, the entrance end of conveyor section 30 is below the level of conveyor 24, to permit the movement of sheets onto conveyor section 30 to be accelerated. In this position of conveyor section 30, the sheets move onto it very rapidly.

In order to improve the operation of machine 10 and avoid clumping and gapping, it is advisable to support the sheets on their edges on conveyor 24. This will aid in the smooth flow of sheets from conveyor 24 onto conveyor section 30 and then onto an inclined conveyor 32 into a magazine or hopper 34 which is one example of a terminus of the exit end 14. The sheets are supported on their edges on conveyor 24 by means of a support mechanism 36 which is in contact with the face of the leading sheet of the group so that the face of the leading sheet and the bed of the conveyor form an acute angle which faces the exit end 14.

Now that the method of the invention and the apparatus of the preferred embodiment have been described in broad terms, one may proceed to a detailed description of the novel features of the machine 10.

FIGS. 7 and 7A, joined on lines A—A, together are a side elevational view of machine 30 and FIG. 8, to a smaller scale, is a plan view thereof. A stack of sheets 16 arrives on the customer's conveyor 18. As referred to herein, the "customer's conveyor" is intended to designate the existing materials handling system already in the plant as contradistinguished from the apparatus of the invention. Support means 36 comprises a pair of longitudinally extending, endless chains 38 and a support bar 40. The chains 38 are spaced from each other transversely across the machine and bar 40 is attached thereto so that an end of the bar is connected to one of the chains. The bar extends transversely across the conveyor 24.

After the sheets reach the upset position 25 and the sheets are placed on their edges by means of forks 26 and 28 so that the sheets will be delivered to hopper 34 in the proper faced orientation, the sheets are held by support bar 40. Support bar 40, when the proper predetermined condition is reached, moves in synchronism with conveyor 24 so that the sheets supported on their edges are rapidly moved onto conveyor section 30. In this condition, the entrance end of conveyor section 30 is below the level of conveyor 24.

At the same time as the leading sheet contacts the trailing sheet of the preceding group, the bar 40 is carried around sprockets 41 and out of contact with the lead sheet and the sheets are shingled onto the previous sheets. If there is no preceding group and a clump is formed, the clump must be cleared manually and the first several sheets must be shingled by hand.

A stack of sheets 16 (stack 1) is delivered on infeed conveyor 20 from customer's conveyor 18 and is detected by limit switch LS-22, located at the front edge of infeed conveyor 20, and infeed conveyor motor M-2 starts if there is no stack on infeed conveyor 20. As the trailing edge of stack 1 leaves conveyor 18, switch LS-23 opens thereby stopping conveyor 18. Stack 1 moves on infeed conveyor 20 until it is stopped by gates 22. Switches LS-1A and LS-1B aid in the squaring of the stack to the gates 22. When both limit switches LS-1A and LS-1B are closed, customer's conveyor 18 is started and stack 2 is brought up to LS-22 and conveyor 18 stops. At the same time motor M-2 is also stopped. Using sensors LS-18 and LS-19, stack 1 is centered by means of motor M-1 which moves conveyor 20 to the desired transverse position. Conveyor 20 is seen to be comprised of rollers 42 carried by a subframe **42*a* which is coupled to motor M-1 for transverse movement of the conveyor 20 relative to conveyor 24 by means of a drive arrangement 42*b*.**

After stack 1 is centered on conveyor 20, gates 22, which are operated by cylinders C-5 and C-6, drop and motors M-3 and M-2 start. Motor M-3 is a two speed motor and, at this time, drives belts 44 of conveyor 24 at its slow speed, say, about 30 feed per minute (FPM). Motor M-2 drives rollers 42 of infeed conveyor 20 at 30 FPM. Thus, stack 1 is moved onto conveyor 24 and after its trailing edge clears gates 22, switch LS-2 opens, gates 22 close and infeed conveyor motor M-2 stops.

Stack 1 proceeds to the upsetting position 25 and when the stack's trailing edge clears switch LS-5 and it opens, motor M-3 stops and aided by brake B-1, the movement of conveyor 24 stops. At the same time cylinders C-1 and C-2 are actuated to raise inner or rear forks 26 toward the rear of stack 1. At the same time, switch LS-14 is closed to help detect stack upset.

As inner forks 26 operated by cylinders C-1 and C-2 approach 75°, cam switch CS-1 closes thereby actuating cylinders C-3 and C-4 to raise the outer forks 28 and causing cylinders C-1 and C-2 to reverse to thereby start the retraction of inner forks 26. When the outer forks 28 reach an angle of about 45°, cylinders C-3 and C-4 stop to thereby stop forks or slats 28 in place. At the same time, inner forks or slats 26 continue to retract until they are fully retracted and switch LS-6 closes.

Chains 38 had previously stopped so that bar 40 was forward of the upsetting position 25. When switch LS-6 closes, motor M-5 is started so that chains 38 move clockwise until support bar 40 is just in contact with the front of the first sheet and clear of forks 28. When this condition is detected by system LS-7 and LS-7A, outer forks 28 drop to their retracted position and the sheets resting on their edges will be supported by the bar 40. If support bar 40 fails to keep all the sheets near the vertical position, or if a few sheets drop under bar 40, LS-14 will be opened by the falling sheets and the next operations will stop. When the outer forks 28 retract to their rest position, switch LS-8 closes.

When switch LS-8 closes, motor M-3 moves conveyor 24 at its fast speed, say, 90 FPM and motor M-5 rotates sprockets 41 to thereby move chains 38 counterclockwise at the same speed so that the conveyor 24 and support bar 40 move in synchronism. At the same time, the entrance of conveyor section 30 drops to its lowest position so that stack 1 can be moved rapidly onto section 30. If switches LS-9 and LS-14 are clear and switch LS-9 closes as the stack reaches it, motors M-3 and M-5 continue to run. When the sheets close switch LS-10, motor cylinders C7 and C8 raise conveyor section 30 to its midposition as described more fully in the aforesaid application of George A. Ventz, Ser. No. 711,479, filed of even date herewith and motors M-3 (at its slow speed), M-6 and M-7 start to run main conveyor 24, conveyor section 30 and inclined conveyor 32 in synchronism at 30 FPM. Support bar 40 continues to move until it is at upsetting position 25. It is stoppd at position 25 until the sheets clear switch LS-9, at which time it moves to its position forward of the upsetting position to await the next group of sheets.

The sheets of stack 1 continue to go forward while the actuation of switch LS-15 signalled gates 22 to open if another stack (stack 2) is on the infeed conveyor. When the sheets of stack 1 clear outer forks 28, switch LS-12 opens. Then the entrance of conveyor section 30 raises and conveyor 24 runs at its slow speed. At the same time, gates 22 open to admit stack 2 to enter main conveyor 24.

At the hopper 34, electric eye switches LS-16 and LS-17 operate in conjunction with reflector 50 to detect the contents of the hopper. Switch LS-17 is above LS-16 so that when the optical path between LS-17 and reflector 50 is interrupted by the hopper contents, motor M-6 and motor M-7 stop so that the conveyor section 30 and inclined conveyor 32 stop. If the sheets of stack 1 are still on conveyor 24, motor M-3 will also stop until the level of hopper 34 drops and electric eye LS-17 is clear. Switch LS-16 senses the low level of sheets in the magazine 34. If the level falls below the desired value, a control is actuated to stop the operation of the following apparatus, e.g. a printer-slotter. The printer-slotter remains off until a sufficient number of sheets are delivered to magazine or hopper 34.

Motors M-1, M-2, M-10 and M-11 are electric motors and motors M-3 and M-5 through M-7 are hydraulic motors. Motor M-11 drives hydraulic pump 51 for supplying power to the hydraulic motors.

It should be understood that while the forks operate to deliver the shingled sheets in the same faced orientation at which they reach the apparatus, they operate with equal facility on stacks on which the faced orientation is reversed in the apparatus.

While a particular embodiment of the apparatus of the invention has been shown and described, it is apparent to those skilled in the art that modifications are possible without departing from the spirit of the invention or the scope of the subjoined claims.

The embodiments of the invention in which an exclusive property or privilege is claimed are defined as follows:

1. The method of feeding sheets such as flat corrugated paperboard sheets used to be formed into packaging cases from a stack of horizontal sheets into a horizontally shingled array of the desired faced orientation toward an exit such as a hopper which comprises:

feeding the stack of sheets onto the entrance of a conveyor;

tilting the stack of sheets to a first posture wherein they are not yet in the horizontally shingled array, but are resting on their edges with the faces of the sheets and the conveyor forming an acute angle facing the exit;

supporting the face of the sheet in the stack closest to the exit such that all the sheets resting on their edges are supported in the first posture to thereby maintain the acute angle facing the exit;

moving the sheets while supported on their edges in the first posture toward the exit; and subsequently dropping the sheets from the first posture and into a second posture wherein the sheets are in the horizontally shingled array on the conveyor shingled toward the exit to thereby deliver them to the exit.

2. Apparatus having an entrance and an exit for receiving a stack of horizontal sheets at the entrance and feeding them to thereby deliver the same toward the exit in a shingled fashion comprising:

a conveyor;

means for delivering the stack of horizontal sheets to the conveyor;

means associated with the conveyor for moving the stack of sheets into a position in which the sheets form a group resting on the edges of the sheets and wherein the faces of the group of sheets and the conveyor form an acute angle facing the exit such that the sheets will be delivered to the exit in the desired faced orientation;

support means for supporting the group of sheets at the leading end of the group to preclude the sheets from falling to a horizontal posture onto the conveyor until a first predetermined condition has been reached;

moving means for moving the support means toward and away from the exit;

actuating means for actuating the moving means to move the support means toward the exit when the first predetermined condition has been reached and for actuating the moving means to move the support means toward the entrance when a second predetermined condition has been reached;

the leading sheet resting against the trailing sheet of the previous group when the second predetermined condition has been reached.

3. The apparatus of claim 2 wherein:

the support means includes a bar having two ends and being oriented transverse to the direction of motion of the conveyor.

4. The apparatus of claim 3 including:

a pair of longitudinally extending, endless chains spaced from each other across the transverse dimension of the conveyor and mounted above the conveyor;

each end of the bar being operatively connected to one of the longitudinally extending chains;

the moving means being connected to the chains to thereby move the chains and the bar operatively connected thereto.

* * * * *